US010109469B2

(12) United States Patent
Green

(10) Patent No.: US 10,109,469 B2
(45) Date of Patent: Oct. 23, 2018

(54) METHOD OF GENERATING ELECTRON TRANSFER DISSOCIATION REAGENT IONS

(71) Applicant: Micromass UK Limited, Wilmslow (GB)

(72) Inventor: Martin Raymond Green, Bowdon (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/274,547

(22) Filed: Sep. 23, 2016

(65) Prior Publication Data

US 2017/0092475 A1 Mar. 30, 2017

(30) Foreign Application Priority Data

Sep. 24, 2015 (GB) ..... 1516926.1

(51) Int. Cl.
*H01J 49/00* (2006.01)
*H01J 49/42* (2006.01)

(52) U.S. Cl.
CPC ..... *H01J 49/0027* (2013.01); *H01J 49/0072* (2013.01); *H01J 49/4205* (2013.01)

(58) Field of Classification Search
CPC .... H01J 49/00; H01J 49/0027; H01J 49/0031; H01J 49/0045; H01J 49/0072; H01J 49/08; H01J 49/147; H01J 49/26
USPC ..... 250/281, 282, 283, 288
See application file for complete search history.

(56) References Cited

U.S. PATENT DOCUMENTS

| | | | | |
|---|---|---|---|---|
| 8,362,424 | B2 * | 1/2013 | Brown | H01J 49/065 250/281 |
| 8,410,437 | B2 * | 4/2013 | Brown | H01J 49/065 250/281 |
| 8,604,419 | B2 | 12/2013 | Nolting et al. | |
| 9,070,539 | B2 * | 6/2015 | Chen | H01J 49/0072 |
| 9,299,553 | B2 | 3/2016 | Whitehouse et al. | |
| 2017/0084437 | A1 * | 3/2017 | Jackson | H01J 49/0072 |

OTHER PUBLICATIONS

Huang et al., "Electron-Transfer Reagent Anion Formation via Electrospray Ionization and Collision-Induced Dissociation", Anal. Chem. vol. 78, No. 21, p. 7387-7391, Nov. 2006.
Coon et al., "Electron Transfer Dissociation of Peptide Anions", J. Am. Soc. Mass Spectrom, vol. 16 p. 880-882, Jun. 2005.
Larraillet et al., "Activated-Electron Photodetachment Dissociation for the Structural Characterization of Protein", Analytical Chemistry, vol. 81, No. 20, p. 8410-8416, Oct. 2009.

* cited by examiner

*Primary Examiner* — Nicole Ippolito
(74) *Attorney, Agent, or Firm* — Womble Bond Dickinson (US) LLP; Deborah M. Vernon; Heath T. Misley

(57) ABSTRACT

A method of mass spectrometry is disclosed wherein ions are subjected to an electron detachment, electron capture or electron transfer process in order to form ions having a different charge state. At least some of the ions having a different charge state are caused to interact with analyte ions to cause at least some of the analyte ions to fragment to form daughter, fragment or product ions.

20 Claims, 1 Drawing Sheet

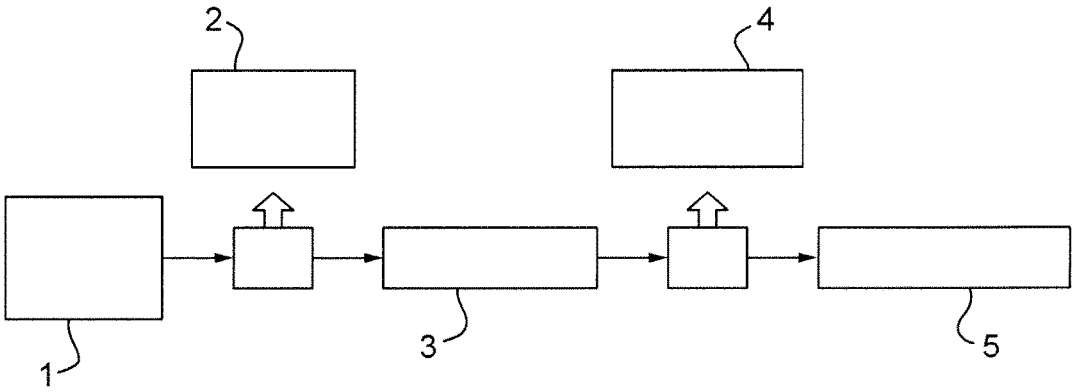
2
4
1
3
5

METHOD OF GENERATING ELECTRON TRANSFER DISSOCIATION REAGENT IONS

CROSS-REFERENCE TO RELATED APPLICATION

This application claims priority from and the benefit of United Kingdom patent application No. 1516926.1 filed on 24 Sep. 2015. The entire contents of this application are incorporated herein by reference.

FIELD OF THE INVENTION

The present invention relates generally to mass spectrometry and in particular to methods of generating Electron Transfer Dissociation ("ETD") reagent ions.

BACKGROUND

Electrospray Ionisation ("ESI") ion sources are well known and may be used to convert neutral peptides eluting from a High Performance Liquid Chromatography ("HPLC") column into gas-phase analyte ions. In an aqueous acidic solution, tryptic peptides will be ionised on both the amino terminus and the side chain of the C-terminal amino acid. As the peptide ions proceed to enter a mass spectrometer the positively charged amino groups hydrogen bond and transfer protons to the amide groups along the backbone of the peptide.

It is known to fragment peptide ions by increasing the internal energy of the peptide ions through collisions with a collision gas. The internal energy of the peptide ions is increased until the internal energy exceeds the activation energy necessary to cleave the amide linkages along the backbone of the molecule. This process of fragmenting ions by collisions with a neutral collision gas is commonly referred to as Collision Induced Dissociation ("CID"). The fragment ions which result from Collision Induced Dissociation ("CID") are commonly referred to as b-type and y-type fragment or product ions, wherein b-type fragment ions contain the amino terminus plus one or more amino acid residues and y-type fragment ions contain the carboxyl terminus plus one or more amino acid residues.

Other methods of fragmenting peptides are known. An alternative method of fragmenting peptide ions is to interact the peptide ions with thermal electrons by a process known as Electron Capture Dissociation ("ECD"). Electron Capture Dissociation ("ECD") cleaves the peptide in a substantially different manner to the fragmentation process which is observed with Collision Induced Dissociation ("CID"). In particular, Electron Capture Dissociation ("ECD") cleaves the backbone N—$C_\alpha$ bond or the amine bond and the resulting fragment ions which are produced are commonly referred to as c-type and z-type fragment or product ions. Electron Capture Dissociation ("ECD") is believed to be non-ergodic i.e. cleavage occurs before the transferred energy is distributed over the entire molecule. Electron Capture Dissociation ("ECD") also occurs with a lesser dependence on the nature of the neighbouring amino acid and only the N-side of proline is 100% resistive to Electron Capture Dissociation ("ECD") cleavage.

One advantage of fragmenting peptide ions by Electron Capture Dissociation ("ECD") rather than by Collision Induced Dissociation ("CID") is that Collision Induced Dissociation ("CID") suffers from a propensity to cleave Post Translational Modifications ("PTMs") making it difficult to identify the site of modification. By contrast, fragmenting peptide ions by Electron Capture Dissociation ("ECD") tends to preserve Post Translational Modifications ("PTMs") arising from, for example, phosphorylation and glycosylation.

However, the technique of Electron Capture Dissociation ("ECD") suffers from the significant problem that it is necessary simultaneously to confine both positive ions and electrons at near thermal kinetic energies. Electron Capture Dissociation ("ECD") has been demonstrated using Fourier Transform Ion Cyclotron Resonance ("FT-ICR") mass analysers which use a superconducting magnet to generate large magnetic fields. However, such mass spectrometers are very large and are prohibitively expensive for the majority of mass spectrometry users.

As an alternative to Electron Capture Dissociation ("ECD") it has been demonstrated that it is possible to fragment peptide ions by reacting negatively charged reagent ions with multiply charged analyte cations in a linear ion trap. The process of reacting positively charged analyte ions with negatively charged reagent ions has been referred to as Electron Transfer Dissociation ("ETD"). Electron Transfer Dissociation ("ETD") is a mechanism wherein electrons are transferred from negatively charged reagent ions to positively charged analyte ions. After electron transfer, the charge-reduced peptide or analyte ion dissociates through the same mechanisms which are believed to be responsible for fragmentation by Electron Capture Dissociation ("ECD") i.e. it is believed that Electron Transfer Dissociation ("ETD") cleaves the amine bond in a similar manner to Electron Capture Dissociation ("ECD"). As a result, the product or fragment ions which are produced by Electron Transfer Dissociation ("ETD") of peptide analyte ions comprise mostly c-type and z-type fragment or product ions.

One particular advantage of Electron Transfer Dissociation ("ETD") is that such a process is particularly suited for the identification of Post Translational Modifications ("PTMs") since weakly bonded Post Translational Modifications ("PTMs") like phosphorylation or glycosylation will survive the electron induced fragmentation of the backbone of the amino acid chain.

It is known to perform Electron Transfer Dissociation ("ETD") by mutually confining cations and anions in a 2D linear ion trap which is arranged to promote ion-ion reactions between reagent anions and analyte cations. The cations and anions are simultaneously trapped within the 2D linear ion trap by applying an auxiliary axially confining RF pseudo-potential barrier at both ends of the 2D linear quadrupole ion trap.

Another method of performing Electron Transfer Dissociation ("ETD") is known wherein a fixed DC axial potential is applied at both ends of a 2D linear quadrupole ion trap in order to confine ions having a certain polarity (e.g. reagent anions) within the ion trap. Ions having an opposite polarity (e.g. analyte cations) to those confined within the ion trap are then directed into the ion trap. The analyte cations will react with the reagent anions already confined within the ion trap.

It is known that when multiply charged (analyte) cations are mixed with (reagent) anions then loosely bound electrons may be transferred from the (reagent) anions to the multiply charged (analyte) cations. Energy is released into the multiply charged (analyte) cations and the multiply charged (analyte) cations may be caused to dissociate. However, some of the (analyte) cations may not dissociate but may instead be reduced in charge state. The (analyte) cations may be reduced in charge by one of two processes. Firstly, the (analyte) cations may be reduced in charge by Electron Transfer ("ET") of electrons from the (reagent) anions to the (analyte) cations. Secondly, the (analyte) cations may be reduced in charge by Proton Transfer ("PT") of protons from the (analyte) cations to the (reagent) anions. Irrespective of the process, an abundance of charged reduced product ions are observed within mass spectra and give an indication of the degree of ion-ion reactions (either Electron Transfer ("ET") or Proton Transfer ("PT")) that are occurring.

In bottom-up or top-down proteomics Electron Transfer Dissociation ("ETD") experiments may be performed in order to maximize the information available by maximizing the abundance of dissociated product ions within mass spectra. The degree of Electron Transfer Dissociation ("ETD") fragmentation depends upon the conformation of the cations (and anions) together with many other instrumental factors. It can be difficult to know a priori the optimal parameters for every anion-cation combination from a Liquid Chromatography ("LC") run.

One problem with known Electron Transfer Dissociation ("ETD") arrangements is that the fragment or product ions resulting from the Electron Transfer Dissociation ("ETD") process tend to be multiply charged and also tend to have relatively high charge states. This is problematic since highly charged fragment or product ions can be hard for a mass spectrometer to resolve. The parent or analyte ions which are fragmented by Electron Transfer Dissociation ("ETD") may, for example, have a charge state of $5^+$, $6^+$, $7^+$, $8^+$, $9^+$, $10^+$ or higher and the resulting fragment or product ions may, for example, have a charge state of $4^+$, $5^+$, $6^+$, $7^+$, $8^+$, $9^+$ or higher.

In particular, it is desired to provide higher charge state Electron Transfer Dissociation ("ETD") reagent ions which may have a relatively large reaction cross section.

It is also desired to produce candidate radical anions (or cations) for positive (or negative) Electron Transfer Dissociation ("ETD") from Electrospray Ionisation ("ESI") amenable compounds rather than be restricted to the current small subset of compounds as at present.

It is therefore desired to provide an improved method of generating Electron Transfer Dissociation ("ETD") reagent ions.

SUMMARY

According to an aspect there is provided a method of mass spectrometry comprising:

subjecting first ions having a charge state m to an electron detachment, electron capture or electron transfer process to form second ions having a charge state n, wherein $m \neq n$; and causing at least some of the second ions to interact with analyte ions so as to cause at least some of the analyte ions to fragment in order to form daughter, fragment or product ions.

According to various embodiments Electron Transfer Dissociation ("ETD") reagent ions may be generated by electron detachment, electron capture or electron transfer from primary ions (first ions) which have been created by Electrospray Ionisation ("ESI") or other forms of ionisation. The Electron Transfer Dissociation ("ETD") reagent ions produced may have a different charge state with respect to the primary ions. The reagent ions may then subsequently be interacted with positively or negatively charged analyte ions so as to fragment analyte ions to produce daughter, product or fragment ions by an electron transfer (or equivalent) process (e.g. positive Electron Transfer Dissociation or negative Electron Transfer Dissociation).

The various embodiments facilitate the production of multiply charged Electron Transfer Dissociation ("ETD") reagent ions (c.f. singly charged Electron Transfer Dissociation ("ETD") reagent ions) which increases the efficiency of the Electron Transfer Dissociation ("ETD") process.

The various embodiments allow many Electron Transfer Dissociation ("ETD") reagent ions to be produced from a variety of different compound classes and ionisation methods, thereby extending the range of compounds which may be used as Electron Transfer Dissociation ("ETD") reagents.

According to various embodiments the electron detachment, electron capture or electron transfer process may be selected from the group consisting of: (i) Electron Photo Detachment ("EPD"); (ii) Electron Detachment (Dissociation) ("EDD"); (iii) Electron Capture (Dissociation) ("ECD"); (iv) Negative Electron Transfer (Dissociation) ("nETD"); (v) Electron Transfer (Dissociation) ("ETD"); (vi) Charge Transfer (Dissociation) ("CTD"); and (vii) Metastable Atom (Dissociation) ("MAD").

The method may further comprise ionising a reagent compound to form the first ions.

According to various embodiments the reagent may comprise a protein or a peptide.

The step of ionising the reagent compound may comprise subjecting the reagent compound to Electrospray Ionisation ("ESI").

Alternatively, the step of ionising the reagent compound may comprise subjecting the reagent compound to Atmospheric Pressure Chemical Ionisation ("APCI"), photo-ionisation or other ionisation processes.

The method may further comprise ionising analyte to form the analyte ions.

The step of ionising the analyte may comprise subjecting the analyte to Electrospray Ionisation ("ESI").

Alternatively, the step of ionising the analyte may comprise subjecting the analyte to Atmospheric Pressure Chemical Ionisation ("APCI"), photo-ionisation or other ionisation processes.

At least some of the second ions may comprise radical ions, reagent ions or radical reagent ions.

The analyte ions may fragment to form the daughter, fragment or product ions by Electron Transfer Dissociation ("ETD").

In various embodiments the analyte ions may comprise positively charged ions (cations) and the second ions may comprise negatively charged ions (anions). In these embodiments, the analyte ions may fragment to form the daughter, fragment or product ions by positive Electron Transfer Dissociation.

In other embodiments the analyte ions may alternatively comprise negatively charged ions (anions) and the second ions may comprise positively charged ions (cations). In these embodiments, the analyte ions may fragment to form the daughter, fragment or product ions by negative Electron Transfer Dissociation ("nETD").

The method may further comprise storing or trapping the first ions in a first ion trap, first ion trapping region or first reaction cell.

The method may further comprise subjecting the first ions to the electron detachment, electron capture or electron transfer process whilst the first ions are stored or trapped in the first ion trap, first ion trapping region or first reaction cell.

The electron detachment, electron capture or electron transfer process may comprise exposing the first ions to an electron beam.

The electron detachment, electron capture or electron transfer process may comprise exposing the first ions to ultra violet radiation or electromagnetic radiation.

The electron detachment, electron capture or electron transfer process may comprise exposing the first ions to radical cations, radical anions, ions or metastable atoms.

The method may further comprise mass filtering the second ions in order to select certain second ions to interact with at least some of the analyte ions.

The method may further comprise mass filtering at least some of the analyte ions in order to select certain analyte ions to interact with at least some of the second ions.

The method may further comprise storing, trapping or confining at least some of the second ions in a first ion trap, first ion trapping region or first reaction cell and/or in a second ion trap, second ion trapping region or second reaction cell and directing at least some of the analyte ions into the first ion trap, first ion trapping region or first reaction cell and/or into the second ion trap, second ion trapping region or second reaction cell in order to interact with the at least some second ions.

The method may further comprise storing, trapping or confining at least some of the analyte ions in a first ion trap, first ion trapping region or first reaction cell and/or in a second ion trap, second ion trapping region or second reaction cell and directing at least some of the second ions into the first ion trap, first ion trapping region or first reaction cell and/or into the second ion trap, second ion trapping region or second reaction cell in order to interact with the at least some analyte ions.

The method may further comprise directing at least some of the second ions and at least some of the analyte ions into a first ion trap, first ion trapping region or first reaction cell and/or into a second ion trap, second ion trapping region or second reaction cell in order that the at least some second ions interact with at least some analyte ions.

The analyte ions may comprise biomolecular ions, protein ions, peptide ions or metabolite ions.

The daughter, fragment or product ions may comprise c-type and/or z-type peptide ions.

The first ions may comprise singly or multiply charged ions.

The first ions may have a charge state of 1, 2, 3, 4, 5, 6, 7, 8, 9, 10, 11, 12, 13, 14, 15, 16, 17, 18, 19, 20 or >20.

The second ions may comprise singly or multiply charged ions.

The second ions may have a charge state of 1, 2, 3, 4, 5, 6, 7, 8, 9, 10, 11, 12, 13, 14, 15, 16, 17, 18, 19, 20 or >20.

The analyte ions may comprise multiply charged ions.

The analyte ions may have a charge state of 2, 3, 4, 5, 6, 7, 8, 9, 10, 11, 12, 13, 14, 15, 16, 17, 18, 19, 20 or >20.

According to various embodiments m may be 1, 2, 3, 4, 5, 6, 7, 8, 9, 10, 11, 12, 13, 14, 15, 16, 17, 18, 19, 20 or >20.

According to various embodiments n may be 1, 2, 3, 4, 5, 6, 7, 8, 9, 10, 11, 12, 13, 14, 15, 16, 17, 18, 19, 20 or >20.

According to various embodiments m>n. According to other embodiments m<n.

According to various embodiments $|m-n|=1$ i.e. the difference in charge state between m and n is 1.

The second ions may comprise reagent ions and in particular they may comprise Electron Transfer Dissociation ("ETD") reagent ions.

According to another aspect there is provided a mass spectrometer comprising:

a device arranged and adapted to subject first ions having a charge state m to an electron detachment, electron capture or electron transfer process to form second ions having a charge state n, wherein m≠n; and a device arranged and adapted to cause at least some of the second ions to interact with analyte ions so as to cause at least some of the analyte ions to fragment to form daughter, fragment or product ions.

According to another aspect there is provided a method of mass spectrometry comprising:

subjecting first ions having a charge state m to an electron detachment, electron capture or electron transfer process in order to form second ions having a charge state n, wherein m≠n or n<m; and causing at least some of the second ions to interact with analyte ions so as to reduce the charge state of the analyte ions.

According to another aspect there is provided a mass spectrometer comprising:

a device arranged and adapted to subject first ions having a charge state m to an electron detachment, electron capture or electron transfer process in order to form second ions having a charge state n, wherein m≠n or n<m; and a device arranged and adapted to cause at least some of the second ions to interact with analyte ions so as to reduce the charge state of the analyte ions.

According to an aspect there is provided a method of Electron Transfer Dissociation ("ETD") comprising:

subjecting first ions having a charge state m to an electron detachment, electron capture or electron transfer process in order to form second ions having a charge state n, wherein m≠n; and causing at least some of the second ions to interact with analyte ions so as to cause at least some of the analyte ions to fragment to form daughter, fragment or product ions.

According to an aspect there is provided an Electron Transfer Dissociation ("ETD") apparatus comprising:

a device arranged and adapted to subject first ions having a charge state m to an electron detachment, electron capture or electron transfer process in order to form second ions having a charge state n, wherein m≠n; and a device arranged and adapted to cause at least some of the second ions to interact with analyte ions so as to cause at least some of the analyte ions to fragment to form daughter, fragment or product ions.

According to an aspect there is provided a method of Proton Transfer Reaction comprising:

subjecting first ions having a charge state m to an electron detachment, electron capture or electron transfer process in order to form second ions having a charge state n, wherein m≠n or n<m; and causing at least some of the second ions to interact with analyte ions so as to reduce the charge state of the analyte ions.

According to an aspect there is provided a Proton Transfer Reaction apparatus comprising:

a device arranged and adapted to subject first ions having a charge state m to an electron detachment, electron capture or electron transfer process in order to form second ions having a charge state n, wherein m≠n or n<m; and a device arranged and adapted to cause at least some of the second ions to interact with analyte ions so as to reduce the charge state of the analyte ions.

According to an aspect there is provided a method of generating reagent ions for Electron Transfer Dissociation ("ETD") comprising:

ionising a reagent compound to produce a primary ion species with a first charge state;

subjecting the primary ion species to an electron detachment or electron capture process to produce a radical reagent ion of different charge than the charge state of the primary ion species; and reacting the radical reagent ion with an analyte ion to produce Electron Transfer Dissociation ("ETD") products.

According to an embodiment the analyte ions may be positively charged and the reagent ions may be negatively charged. According to alternative embodiments the analyte ions may be negatively charged and the reagent ions may be positively charged.

According to an embodiment the mass spectrometer may further comprise:

(a) an ion source selected from the group consisting of: (i) an Electrospray Ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI"); and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation ("CID") fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation ("ETD") device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) > about 500 V peak to peak.

The AC or RF voltage may have a frequency selected from the group consisting of: (i) < about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) > about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) < about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) > about 1000 mbar.

According to an embodiment analyte ions may be subjected to Electron Transfer Dissociation ("ETD") fragmentation in an Electron Transfer Dissociation ("ETD") fragmentation device. Analyte ions may be caused to interact with Electron Transfer Dissociation ("ETD") reagent ions within an ion guide or fragmentation device.

According to an embodiment in order to effect Electron Transfer Dissociation ("ETD") either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation ("ETD"): (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation ("ETD") fragmentation comprises interacting analyte ions with reagent ions, wherein the reagent ions comprise dicyanobenzene, 4-nitrotoluene or azulene.

A chromatography detector may be provided wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The mass spectrometer may be operated in various modes of operation including a mass spectrometry ("MS") mode of operation, a tandem mass spectrometry ("MS/MS") mode of operation, a mode of operation in which parent or precursor ions are alternatively fragmented or reacted so as to produce fragment or product ions, and not fragmented or reacted or fragmented or reacted to a lesser degree, a Multiple Reaction Monitoring ("MRM") mode of operation, a Data Dependent Analysis ("DDA") mode of operation, a Data Independent Analysis ("DIA") mode of operation, a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawing in which:

FIG. 1 shows an instrument arrangement which may be used to generate Electron Transfer Dissociation ("ETD") reagent ions according to an embodiment.

DETAILED DESCRIPTION

Electron Transfer Dissociation ("ETD") reagent ions for positive ion Electron Transfer Dissociation ("ETD") are known which comprise reactive singly charged radical anions formed by techniques such as Chemical Ionisation ("CI") or glow discharge from a volatilized sample. However, as will be understood by those skilled in the art, not all radical anions give rise to Electron Transfer Dissociation ("ETD"). It is known that the best reagents have a favourable Franck-Condon factor (overlap between anionic and neutral states of the reagent) and a relatively low electron affinity.

The efficiency of Electron Transfer Dissociation ("ETD") increases as the target or analyte ion becomes more positively charged and/or as the reagent ions become more negatively charged.

Methods to produce singly charged Electron Transfer Dissociation ("ETD") reagent ions by Electrospray Ionisation ("ESI") are known. For example, it is known to subject arenecarboxylic acids which have been ionised by Electrospray Ionisation ("ESI") to Collision Induced Dissociation ("CID") fragmentation. The resulting fragment or product ions after loss of CO2 may be used as reagent ions. This method circumvents difficulties associated with the formation of high mass to charge ratio reagent anions.

It is desirable to produce higher charge state Electron Transfer Dissociation ("ETD") reagent ions since they may have a relatively larger reaction cross section. It is also desirable to produce candidate radical (reagent) anions or cations for positive or negative Electron Transfer Dissociation ("ETD") from many Electrospray Ionisation ("ESI") amenable compounds rather than be restricted to a small subset of compounds as at present.

According to various embodiments reagent ions (second ions) may be generated by electron detachment, electron capture or electron transfer from primary ions (first ions) which may initially be created or generated by Electrospray Ionisation ("ESI") or other ionisation processes. The primary ions (first ions) may have a charge state m; the reagent ions (second ions) may have a charge state n; and the charge state m of the primary ions (first ions) is different to the charge state n of the reagent ions (second ions), i.e. m≠n. The resulting reagent ions (second ions) may then subsequently be reacted (caused to interact) with analyte ions so as to cause analyte ions to fragment, e.g. by Electron Transfer Dissociation ("ETD"), to produce (Electron Transfer Dissociation ("ETD")) daughter, fragment or product ions. The daughter, fragment or product ions may then be analysed, e.g. by mass spectrometry and/or by ion mobility spectrometry.

According to various embodiments a reagent (compound), e.g. small proteins or large peptides, may be arranged (ionised) so as to form highly charged primary negatively charged ions or anions (first ions) by subjecting the reagent (compound) to Electrospray Ionisation ("ESI") in negative Electrospray Ionisation ("ESI") mode. Methods of electron detachment are known and may be used to produce abundant relatively stable radical positively charged ions or cations (second ions) of more positive charge than the negatively charged primary ions (first ions).

Positive radical cations (second ions) for negative Electron Transfer Dissociation ("nETD") (i.e. dissociation of negatively charged analyte ions) may be formed by this method. It is known that negative Electron Transfer Dissociation ("nETD") may be performed using xenon radical cations.

Highly charged negatively charged radical ions may be generated and used as Electron Transfer Dissociation ("ETD") reagent ions (second ions). For example, ions of the form $[M\text{-}nH]^{-n-}$ where n>2 may be generated from highly charged parent or precursor ions (first ions) such as small proteins.

The use of highly charged Electron Transfer Dissociation ("ETD") reagent ions (second ions) according to various embodiments results in an improvement in the efficiency of Electron Transfer Dissociation ("ETD") for multiply charged analyte ions and facilitates efficient Electron Transfer Dissociation ("ETD") for singly charged analyte ions.

Various methods for producing radical cations and/or anions (second ions) from primary ions (first ions) may be utilised according to various embodiments and involve an electron capture, electron detachment or electron transfer process. Examples of some of the electron capture, electron detachment or electron transfer processes which may be utilised according to various embodiments are given below.

The radical reagent ions (second ions) which may be used for subsequent Electron Transfer Dissociation ("ETD") are shown below in bold.

1. Electron photo detachment: UV laser or lamp ("EPD")

$$[M\text{-}nH]^{-n} \xrightarrow{hv} [M\text{-}nH]^{-(n-1)\bullet} + e^-$$

$$[M\text{-}nH]^{+n} \xrightarrow{hv} [M\text{-}nH]^{+(n+1)\bullet} + e^-$$

2. Electron detachment (dissociation) ("EDD")

$$[M\text{-}nH]^{-n} \xrightarrow{e-} [M\text{-}nH]^{-(n-1)\bullet} + e^-$$

3. Electron capture (dissociation) ("ECD")

$$[M\text{-}nH]^{+n} \xrightarrow{e^-} [M\text{-}nH]^{+(n-1)\bullet}$$

4. Negative Electron Transfer (dissociation) ("nETD")

$$[M\text{-}nH]^{-n} + A^{+\bullet} \longrightarrow [M\text{-}nH]^{-(n+1)\bullet} + A$$

5. Electron Transfer (dissociation) ("ETD")

$$[M\text{-}nH]^{+n} + A^{-\bullet} \longrightarrow [M\text{-}nH]^{+(n-1)\bullet} + A$$

6. Charge Transfer (dissociation) ("CTD")

$$[M\text{-}nH]^{+n} \xrightarrow{\text{kV energy } He^+} [M\text{-}nH]^{+(n+1)\bullet}$$

-continued

7. Metastable Atom (dissociation) ("MAD")

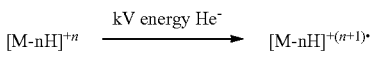

$$[M\text{-}nH]^{+n} \xrightarrow{\text{kV energy } He^-} [M\text{-}nH]^{+(n+1)\bullet}$$

Thus according to various embodiments radical reagent ions (second ions) may be formed by (the electron detachment, electron capture or electron transfer process may comprise) Electron Photo Detachment ("EPD") wherein for example, ultra violet ("UV") radiation having energy hv interacts with an ion (first ion), e.g. $[M\text{-}nH]^{-n}$ or $[M\text{-}nH]^{+n}$, to form a radical reagent ion (second ion), e.g. $[M\text{-}nH]^{-(n-1)*}$ or $[M\text{-}nH]^{+(n+1)*}$ respectively.

According to other embodiments radical reagent ions (second ions) may be formed by (the electron detachment, electron capture or electron transfer process may comprise) Electron Detachment (Dissociation) ("EDD") wherein for example, electrons e− interact with an ion (first ion), e.g. $[M\text{-}nH]^{-n}$, to form a radical reagent ion (second ion), e.g. $[M\text{-}nH]^{-(n-1)*}$.

According to other embodiments radical reagent ions (second ions) may be formed by (the electron detachment, electron capture or electron transfer process may comprise) Electron Capture (Dissociation) ("ECD") wherein for example, electrons e− interact with an ion (first ion), e.g. $[M\text{-}nH]^{+n}$, to form a radical reagent ion (second ion), e.g. $[M\text{-}nH]^{+(n-1)*}$.

According to other embodiments radical reagent ions (second ions) may be formed by (the electron detachment, electron capture or electron transfer process may comprise) Negative Electron Transfer (Dissociation) ("nETD") wherein for example, a radical cation, e.g. $A^{+*}$, interacts with an ion (first ion), e.g. $[M\text{-}nH]^{-n}$, to form a radical reagent ion (second ion), e.g. $[M\text{-}nH]^{-(n+1)*}$.

According to other embodiments radical reagent ions (second ions) may be formed (the electron detachment, electron capture or electron transfer process may comprise) Electron Transfer (Dissociation) ("ETD") wherein for example, a radical anion, e.g. $A^{-*}$, interacts with an ion (first ion), e.g. $[M\text{-}nH]^{+n}$, to form a radical reagent ion (second ion), e.g. $[M\text{-}nH]^{+(n-1)*}$.

According to other embodiments radical reagent ions (second ions) may be formed by (the electron detachment, electron capture or electron transfer process may comprise) Charge Transfer (Dissociation) ("CTD"), wherein for example, ions interact with an ion (first ion), e.g. $[M\text{-}nH]^{+n}$, to form a radical reagent ion (second ion), e.g. $[M\text{-}nH]^{+(n+1)*}$.

According to yet further embodiments radical reagent ions (second ions) may be formed by (the electron detachment, electron capture or electron transfer process may comprise) Metastable Atom (Dissociation) ("MAD") wherein for example, metastable atoms interact with an ion (first ion), e.g. $[M\text{-}nH]^{+n}$, to form a radical reagent ion (second ion), e.g. $[M\text{-}nH]^{+(n+1)*}$.

Thus according to various embodiments the electron detachment, electron capture or electron transfer process may be selected from the group consisting of: (i) Electron Photo Detachment ("EPD"); (ii) Electron Detachment (Dissociation) ("EDD"); (iii) Electron Capture (Dissociation) ("ECD"); (iv) Negative Electron Transfer (Dissociation) ("nETD"); (v) Electron Transfer (Dissociation) ("ETD"); (vi) Charge Transfer (Dissociation) ("CTD"); and (vii) Metastable Atom (Dissociation) ("MAD").

According to various embodiments the electron detachment, electron capture or electron transfer process may comprise exposing the first ions to an electron beam, ultra violet radiation, electromagnetic radiation, radical cations, radical anions, ions or metastable atoms.

FIG. 1 shows a schematic of a mass spectrometer instrument geometry which may be used according to various embodiments in order to generate reagent ions (second ions) and which also may be used to perform positive and/or negative Electron Transfer Dissociation ("ETD") reactions with analyte ions.

As shown in FIG. 1, a reagent (compound) may first be ionised by Electrospray Ionisation ("ESI") (or another ionisation process) in (or via) an ion source 1. As a result of the ionisation process (primary) reagent ions (first ions) are produced and the resulting (primary) reagent ions (first ions) may then be trapped in a first trapping region, ion trap or reaction cell 2. The primary reagent ions (first ions) may then subjected to an electron detachment, electron capture or electron transfer process according to various embodiments.

For example, according to an embodiment radical (secondary) reagent ions (second ions) may be formed by exposing the primary reagent ions (first ions) to an electron beam or by exposing the primary reagent ions to ultra violet ("UV") radiation or by exposing the primary reagent ions (first ions) to radical cations, radical anions, ions or metastable atoms.

According to various embodiments the electron detachment, electron capture or electron transfer process may be arranged to occur within the ion source 1, ion trap or reaction cell 2 or an ion guide or ion guiding region of the mass spectrometer.

Thus the mass spectrometer comprises a device (e.g. reaction cell 2) arranged and adapted to subject the first ions having a charge state m to an electron detachment, electron capture or electron transfer process in order to form the second ions having a charge state n, wherein $m \neq n$.

Specific secondary reagent ions (second ions) may then be isolated by removing some or all of the secondary reagent ions (second ions) from the first trapping region, ion trap or reaction cell 2 and passing the secondary reagent ions (second ions) through a quadrupole mass filter 3 which may be arranged to mass filter the secondary reagent ions (second ions). The mass filtered secondary reagent ions (second ions) may then be stored in a second trapping region, ion trap or reaction cell 4.

Analyte ions of opposite polarity to that of the secondary reagent ions (second ions) may then be produced or otherwise generated in the ion source 1 (or a different ion source). The analyte ions (of opposite polarity) may then optionally also be mass filtered by the quadrupole mass filter 3 (or a different quadrupole mass filter) so that only analyte ions having specific mass to charge ratios may then be introduced into the second trapping region, ion trap or reaction cell 4.

According to various embodiments ion-ion interactions and in particular Electron Transfer Dissociation ("ETD") (or other processes) may be arranged to occur within the second trapping region, ion trap or reaction cell 4. The resulting daughter, fragment or product ions may then be sent or otherwise transmitted to a downstream mass analyser 5 for further analysis.

Thus according to various embodiments the mass spectrometer further comprises a device (e.g. second trapping region, ion trap or reaction cell 4) arranged and adapted to cause at least some of the second ions to interact with the analyte ions so as to cause at least some of the analyte ions to fragment to form daughter, fragment or product ions.

Other schemes for implementation according to other various further embodiments are also contemplated. For example, according to an embodiment separate ion sources may be used to ionise separately the analyte and the reagent compounds. Other atmospheric ionisation processes may be used to generate primary ions (first ions). For example, according to an embodiment Atmospheric Pressure Chemical Ionisation ("APCI") or photo-ionisation may be used to ionise either the analyte and/or the reagent (compound). Secondary reagent ions (second ions) may then be generated from primary reagent ions (first ions) by subsequent electron detachment, electron capture or electron transfer processes.

Thus according to various embodiments the mass spectrometer may further comprise a device (e.g. ion source 1) arranged and adapted to ionise analyte to form the analyte ions and/or to ionise a reagent compound to form the first ions.

The same general processes as described above in relation to Electron Transfer Dissociation ("ETD") may also be used to create efficient Proton Transfer Reaction ("PTR") reagents. For example, further embodiments are contemplated wherein first (reagent) ions having a charge state m may be subjected to an electron detachment, electron capture or electron transfer process in order to form secondary (reagent) ions (second ions) having a charge state n, wherein $m \neq n$ or $n<m$. The secondary reagent ions (second ions) may then be interacted with analyte ions in order to reduce the charge state of the analyte ions (e.g. by Proton Transfer Reaction) without substantially causing the analyte ions to fragment. Reducing the charge state of the analyte ions by Proton Transfer Reaction is beneficial since it can be hard for the processing system of a mass spectrometer to resolve analyte ions having a relatively high charge state.

According to these embodiments, the mass spectrometer further comprises a device (e.g. second trapping region, ion trap or reaction cell 4) arranged and adapted to cause at least some of the second ions to interact with analyte ions so as to reduce the charge state of the analyte ions.

Although the present invention has been described with reference to preferred embodiments, it will be understood by those skilled in the art that various changes in form and detail may be made without departing from the scope of the invention as set forth in the accompanying claims.

The invention claimed is:

1. A method of mass spectrometry comprising:

subjecting first ions having a charge state m to an electron detachment, electron capture or electron transfer process in order to form second ions having a charge state n, wherein m n; and causing at least some of said second ions to interact with analyte ions so as to cause at least some of said analyte ions to fragment to form daughter, fragment or product ions.

2. A method as claimed in claim 1, further comprising ionising a reagent compound to form said first ions.

3. A method as claimed in claim 2, wherein the step of ionising said reagent compound comprises subjecting said reagent compound to Electrospray Ionisation ("ESI").

4. A method as claimed in claim 1, wherein at least some of said second ions comprise radical ions, reagent ions or radical reagent ions.

5. A method as claimed in claim 1, wherein said second ions comprise Electron Transfer Dissociation ("ETD") reagent ions.

6. A method as claimed in claimed in claim 1, wherein said analyte ions fragment to form said daughter, fragment or product ions by Electron Transfer Dissociation ("ETD").

7. A method as claimed in claim 1, further comprising storing or trapping said first ions in a first ion trap, first ion trapping region or first reaction cell.

8. A method as claimed in claim 7, further comprising subjecting said first ions to said electron detachment, electron capture or electron transfer process whilst said first ions are stored or trapped in said first ion trap, first ion trapping region or first reaction cell.

9. A method as claimed in claim 1, wherein said electron detachment, electron capture or electron transfer process comprises exposing said first ions to an electron beam.

10. A method as claimed in claim 1, wherein said electron detachment process comprises exposing said first ions to ultra violet radiation, electromagnetic radiation, radical cations, radical anions, ions or metastable atoms.

11. A method as claimed in claim 1, further comprising mass filtering said second ions in order to select certain said second ions to interact with at least some of said analyte ions.

12. A method as claimed in claim 1, further comprising mass filtering at least some of said analyte ions in order to select certain said analyte ions to interact with at least some of said second ions.

13. A method as claimed in claim 1, further comprising storing, trapping or confining at least some of said second ions in a first ion trap, first ion trapping region or first reaction cell and/or in a second ion trap, second ion trapping region or second reaction cell and directing at least some of said analyte ions into said first ion trap, first ion trapping region or first reaction cell and/or into said second ion trap, second ion trapping region or second reaction cell in order to interact with said at least some second ions.

14. A method as claimed in claim 1, further comprising storing, trapping or confining at least some of said analyte ions in a first ion trap, first ion trapping region or first reaction cell and/or in a second ion trap, second ion trapping region or second reaction cell and directing at least some of said second ions into said first ion trap, first ion trapping region or first reaction cell and/or into said second ion trap, second ion trapping region or second reaction cell in order to interact with said at least some analyte ions.

15. A method as claimed in claim 1, further comprising directing at least some of said second ions and at least some of said analyte ions into a first ion trap, first ion trapping region or first reaction cell and/or into a second ion trap, second ion trapping region or second reaction cell in order that said at least some second ions interact with said at least some analyte ions.

16. A method as claimed in claim 1, wherein said analyte ions comprise biomolecular ions, protein ions, peptide ions or metabolite ions.

17. A method as claimed in claim 1, wherein said daughter, fragment or product ions comprise c-type and/or z-type peptide ions.

18. A mass spectrometer comprising:

a device arranged and adapted to subject first ions having a charge state m to an electron detachment, electron capture or electron transfer process in order to form second ions having a charge state n, wherein m n; and a device arranged and adapted to cause at least some of said second ions to interact with analyte ions so as to cause at least some of said analyte ions to fragment to form daughter, fragment or product ions.

19. A method of mass spectrometry comprising:

subjecting first ions having a charge state m to an electron detachment, electron capture or electron transfer process in order to form second ions having a charge state n, wherein m n or n<m; and causing at least some of said second ions to interact with analyte ions so as to reduce the charge state of said analyte ions.

20. A mass spectrometer comprising:

a device arranged and adapted to subject first ions having a charge state m to an electron detachment, electron capture or electron transfer process in order to form second ions having a charge state n, wherein m≠n or n<m; and a device arranged and adapted to cause at least some of said second ions to interact with analyte ions so as to reduce the charge state of said analyte ions.

* * * * *